US010465488B2

(12) United States Patent
Collins et al.

(10) Patent No.: US 10,465,488 B2
(45) Date of Patent: Nov. 5, 2019

(54) ZINC ONE PIECE LINK SYSTEM

(71) Applicant: HUNTING TITAN, INC., Pampa, TX (US)

(72) Inventors: William Richard Collins, Burleson, TX (US); Debra Christine McDonald, Whitney, TX (US); Timothy G. Golian, San Antonio, TX (US); Shane Matthew Wilson, Waxahachie, TX (US); Isaiah Acevedo, Chandler, AZ (US)

(73) Assignee: Hunting Titan, Inc., Pampa, TX (US)

( * ) Notice: Subject to any disclaimer, the term of this patent is extended or adjusted under 35 U.S.C. 154(b) by 205 days.

(21) Appl. No.: 15/508,614

(22) PCT Filed: Sep. 4, 2015

(86) PCT No.: PCT/US2015/048667

§ 371 (c)(1),
(2) Date: Mar. 3, 2017

(87) PCT Pub. No.: WO2016/037122

PCT Pub. Date: Mar. 10, 2016

(65) Prior Publication Data

US 2017/0275976 A1 Sep. 28, 2017

Related U.S. Application Data

(60) Provisional application No. 62/045,684, filed on Sep. 4, 2014.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 29/02; E21B 43/119; E21B 43/11857; E21B 43/263; E21B 43/116; E21B 44/00; E21B 47/12; E21B 7/025; F42D 1/00; F42D 1/055; F42B 1/02; F42B 3/26; F42B 3/22; F42B 12/76
USPC ..... 102/32
See application file for complete search history.

(56) References Cited

U.S. PATENT DOCUMENTS 2,927,534 A * 3/1960 Le Bus ..... E21B 43/117 175/4.53
2,981,185 A * 4/1961 Caldwell ..... E21B 43/117 166/55
3,094,930 A * 6/1963 Blair ..... E21B 43/117 175/4.6

(Continued)

OTHER PUBLICATIONS

Office Action, Canadian application No. 2,933,762, dated May 26, 2017, 3 pages.

(Continued)

*Primary Examiner* — Joshua E Freeman
*Assistant Examiner* — Bridget A Cochran
(74) *Attorney, Agent, or Firm* — Christopher McKeon; Jason Saunders; Arnold & Saunders, LLP

(57) ABSTRACT

A link jet system using a combination of a one piece cast zinc alloy case and interlocking linked shaped charges for minimizing debris left in a downhole wellbore when fired, reducing components in system, and providing an easy method for changing the shaped charge phase.

4 Claims, 8 Drawing Sheets

(56) References Cited

U.S. PATENT DOCUMENTS 3,100,443 A * 8/1963 Pohoriles ..... E21B 43/117 102/310
3,143,068 A * 8/1964 Bell ..... E21B 43/117 102/310
3,177,808 A * 4/1965 Owen ..... E21B 43/117 102/310
3,991,836 A * 11/1976 Bouguyon ..... E21B 43/117 175/4.6
4,326,462 A * 4/1982 Garcia ..... F42B 3/02 102/310
4,598,775 A * 7/1986 Vann ..... E21B 43/117 102/310
4,655,138 A * 4/1987 Regalbuto ..... F42B 3/08 102/307
4,716,833 A * 1/1988 Regalbuto ..... E21B 43/117 102/307
4,852,495 A * 8/1989 Hancock ..... E21B 43/117 102/306
4,885,993 A * 12/1989 Hancock ..... E21B 43/117 102/307
5,241,891 A * 9/1993 Hayes ..... E21B 43/117 175/4.6
5,542,480 A * 8/1996 Owen ..... E21B 43/117 102/310
5,816,343 A * 10/1998 Markel ..... E21B 43/117 175/4.51
6,216,596 B1 * 4/2001 Wesson ..... F42B 1/032 102/307
6,244,157 B1 * 6/2001 Tseka ..... E21B 43/117 102/312
6,487,973 B1 * 12/2002 Gilbert, Jr. ..... E21B 43/117 102/312
6,520,258 B1 * 2/2003 Yang ..... E21B 43/117 102/312
6,523,449 B2 * 2/2003 Fayard ..... E21B 43/117 102/310
6,591,911 B1 * 7/2003 Markel ..... E21B 43/117 102/312
6,805,056 B1 * 10/2004 Poe ..... E02B 17/00 102/307
7,387,162 B2 * 6/2008 Mooney, Jr. ..... E21B 43/1185 166/297
7,481,166 B2 * 1/2009 Han ..... E21B 36/003 102/312
7,775,279 B2 * 8/2010 Marya ..... F42D 3/00 102/307
8,347,962 B2 * 1/2013 Sampson ..... E21B 43/117 166/297
2002/0189483 A1 * 12/2002 Parrott ..... E21B 43/117 102/312

OTHER PUBLICATIONS

Response to Office Action, Canadian application No. 2,933,762, dated Nov. 23, 2017, 20 pages.
Notification concerning transmittal of international preliminary report on patentability, PCT Application No. PCT/US15/48667, dated Mar. 16, 2017, 11 pages.
Supplementary European search report, based on EP 15837534, dated Sep. 19, 2017, 5 pages.
Notification of Transmittal of the International Search Report and the Written Opinion of the International Searching Authority, PCT Application No. PCT/US2015/048667, dated Nov. 27, 2015, 13 pages.

* cited by examiner

ZINC ONE PIECE LINK SYSTEM

RELATED APPLICATIONS

This application claims priority to U.S. Provisional Application No. 62/045,684, filed Sep. 4, 2014.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Hydrocarbon deposits may exist within the formation. Typically a wellbore is drilled from a surface location, placing a hole into a formation of interest. Completion equipment is placed downhole after drilling, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a shape and has a thin metal liner on the inner surface of the explosive material. Many materials are used for the liner including brass, copper, tungsten, and lead. When the explosive detonates the liner metal is compressed into a super-heated, super pressurized jet that can penetrate metal, concrete, and rock.

A perforating gun typically has a gun body. The gun body typically is composed of metal and is cylindrical in shape. Within a typical gun tube is a charge holder or carrier tube, which is a tube that is designed to hold the actual shaped charges. The charge holder contains cutouts called charge holes where the shaped charges are placed.

A shaped charge is typically detonated by a booster or igniter. Shaped charges may be detonated by electrical igniters, pressure activated igniters, or detonating cord. One way to ignite several shaped charges is to connect a common detonating cord that is placed proximate to the igniter of each shaped charge. The detonating cord is comprised of material that explodes upon ignition. The energy of the exploding detonating cord can ignite shaped charges that are properly placed proximate to the detonating cord. Often a series of shaped charges may be daisy chained together using detonating cord.

An alternative to using a perforating gun with a gun body is a strip system where the perforating charges are exposed to the downhole environment. The strip system may be conveyed downhole using coiled tubing. A strip system is smaller in diameter and allows for the perforation of casing where size is an issue. The strip system typically may include a series of shaped charges strung together along a loading strip. These shaped charges typically are individually sealed against the downhole environment. When the perforating charges are fired the system may break up, leaving debris inside the wellbore. The remains of the loading strip and anything attached is then removed from the wellbore.

SUMMARY OF EXAMPLES OF THE INVENTION

An example of the invention may include a linked perforating gun system comprising a plurality of shaped charges linked directly to each other in a series, with each shaped charge having a shaped charge case and each shaped charge case having a first stem and a second stem, wherein the first stem and the second stem are 180 degrees opposed to each other about the center axis of the shaped charge case. A variation of the example may include the first stem and second stem being integral to its associated shaped charge case. The first stem may also be a key. The second stem may be a cylindrical socket with a plurality of internal slots adapted to accept a first stem from an adjacent shaped chafe in a corresponding plurality of orientations. The second stem is may be a socket. The socket of the second stem may be configured to allow the first stem of an adjacent perforating shaped charge to interface with the second stem at a plurality of phase angles. The example may further comprise a cap on each shaped charge adapted to seal the contents of the shaped charge from an outside environment. The cap may include an O-ring seal between each shaped charge and its associated cap. The plurality of shaped charge cases and each accompanying first stem and second stem may be composed of zinc alloy. The example may further comprise an extender located between two of the plurality of shaped charge cases, wherein the extender is adapted to adjust the phase angle and shot density of the perforating gun system. The example may include a plurality of pins wherein the socket and the first stem have corresponding through holes that when lined up will accept one of the plurality of pins to effectively lock at least two shaped charges together. The extender may contain a plurality of slots on a first end and key on the second end. The perforating shaped charge may each be individually sealed using a cap placed over the charge case and using an O-ring to provide a water tight seal in a wellbore environment.

Another example of the invention may include a shaped charge comprising a shaped charge case, an explosive material located within the case, a liner located such that the explosive material is between the liner and the charge case, with the shaped charge case having a first stem and a second stem, wherein the first stem and the second stem are 180 degrees opposed to each other. A variation of the example may include the first stem and second stem being integral to the shaped charge case. The first stem may be a male key. The second stem may be a cylindrical female socket. The first stem and second stem may be integral to a retainer ring that snaps into place over the shaped charge case. The example may further comprise a cap on the shaped charge adapted to seal the contents of the shaped charge from an outside environment. The example may further comprise an O-ring seal between each shaped charge and its associated cap. The shaped charge case, first stem, and second stem may all be composed of a zinc alloy. The example may include each shaped charge having a cap covering the opening of the shaped charge such that a water tight seal exist. The first stem may be a rectangular male key. The second stem may comprise a plurality of slots adapted to accept a first stem at a plurality of angles.

An example of the invention may include a method for perforating a wellbore comprising connecting a plurality of shaped charges directly together in a series, threading a detonating cord through each shaped charge, lowering the plurality of shaped charges into a wellbore, and firing the plurality of shaped charges at a predetermined locating within the wellbore. A variation of the invention may include having each shaped charges interface with at last one other shaped charge. The example may further comprise phasing each shaped charge a predetermined number of degrees with respect to each other. It may further comprise adjusting the shot density of the plurality of shaped charges. It may further comprise placing the plurality of shaped charges into a perforating gun tube.

Another example of the invention may include a linked perforating gun system comprising a plurality of shaped charge holder plates linked together in series, each holder plate having a male end connector and a female end connector. The example of the invention may have the female end connector adapted to accept a male end connector at a plurality of phase angles. The example may further comprise a through hole on each holder plate sized to fit a shaped charge at a first orientation. The example may have the shaped charge locked into place in the holder plate by rotating the shaped charge to a second orientation. The example may further comprise a retainer adaptor to lock over a mated female and male connector. The retainer may lock by snapping two halves of the retainer together over the mated female and male connectors. The retainer may lock by screwing two halves of the retainer together over the mated female and male connectors. The shaped charge holder plates may be composed of zinc alloy. The linked shaped charge holder plates may be placed inside a perforating gun body. The female end connector may be a cylindrical disk attached perpendicular to the shaped charge holder plate and further comprising a plurality of slots arrayed such that each slot may accept a male end connector.

Another example of the claimed invention may include a perforating charge holder comprising a first adaptor configured to hold a perforating shaped charge at a preselected phase angle and a second adaptor configured to interface with a loading strip. The first adaptor may snap to a shaped charge case. The first adaptor may screw into a shaped charge case. The second adaptor may screw into the loading strip. The second adaptor may snap into the loading strip. The perforating charge holder may be composed of zinc alloy. The first adaptor may be a ring. The second adaptor may be a ring like base. The example may further include a first and second L-shaped member, each connected to the base and the ring such that the two L-shaped members are mirrors of each other about a centerline of the circular base.

DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures. Briefly.

DETAILED DESCRIPTION OF EXAMPLES OF THE INVENTION

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the appended claims.

In deep wells or long horizontal wells there is a need for small diameter perforation capabilities. Traditionally this was done using a metal loading strip attached to coiled tubing that had a series of shaped charges screwed into place. The shaped charges may have a cap that seals the shaped charge from the downhole environment. This cap can be constructed out of steel or zinc alloy. The loading strip is put into place and the shaped charges fired. Afterwards the loading strip is removed from the well. Problems with prior designs include the fact that the debris from the perforating charges and the loading strip may remain in the well. A potential solution includes the current design which uses frangible materials such as zinc alloys. Using zinc alloy for the shaped charge cases, loading strip, and cap reduces the amount of large debris left in the wellbore. The shaped charge firing pulverizes the zinc alloy into a powder.

Figure 1:
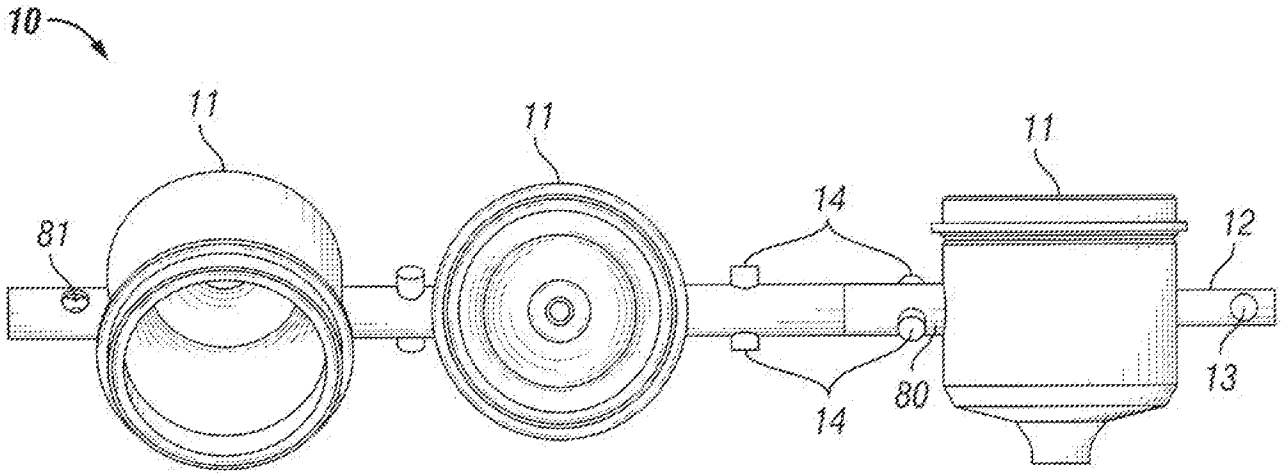
FIG. 1 is a shaped charge link system.

Referring to an example shown in FIG. 1, a linked system 10 is shown using shaped charge cases 11 connected together through a series of interlocking stems 12 and 80, Each shaped charge case 11 has an integral stem 12 that is adapted to fit within integral stem 80. Integral stem 12 has a through hole 13. Integral stem 80 has a through hole 81. When integral stem 12 is inserted into integral stem 80 a pin 14 may be used to secure the integral stems together. The charge case 11, integral stems 12 and 80, and the pins 14 may all be made out of zinc alloy. This allows for the entire linked system 10 to be largely destroyed during the firing process. The zinc alloy is frangible and will shatter when the shaped charges fire. Zinc alloy also breaks apart into smaller pieces than a steel alloy design. Therefore, an advantage offered by this configuration is that the linked system leaves very little large scale debris in the wellbore after firing and is completely expendable. The linked system 10 may also be used within a gun body. The interlocking stems 12 and 80 would replace the charge holder. After firing, the gun body is removed from the wellbore with most of the debris contained therein. Each shaped charge case 11 has a center line along which the explosive output of a shaped charge will likely follow.

Figure 2A:
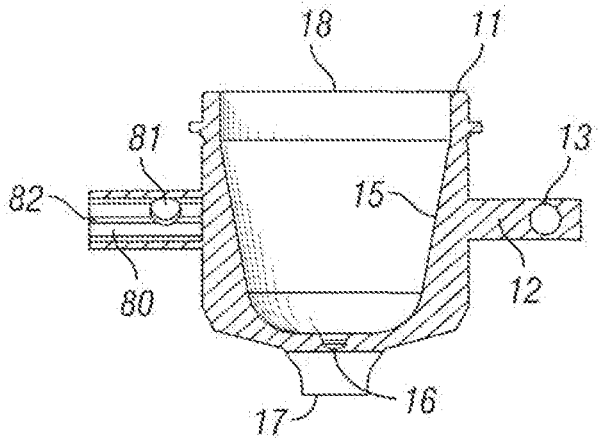
FIGS. 2A, 2B, and 2C are different views of a single lick system shaped charge.
Figure 2B:
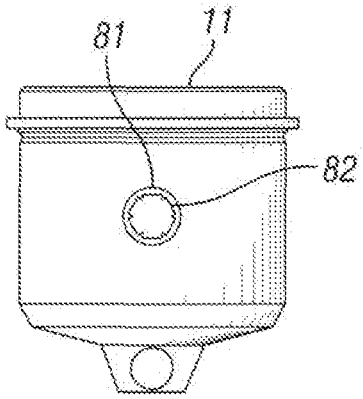
Figure 2C:
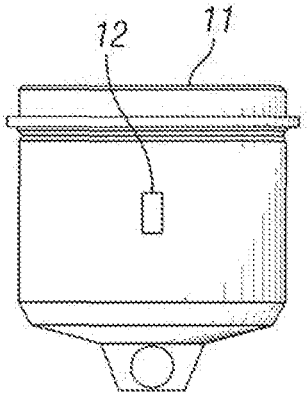
Figure 11:
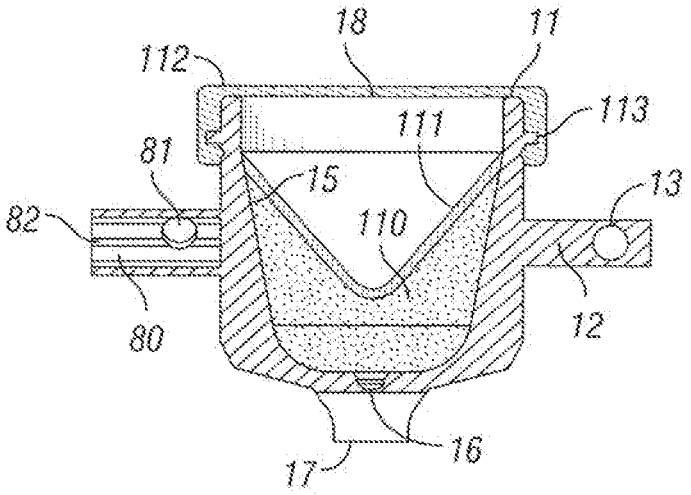
FIG. 11 shows an example of a shape charge for use in a linked system.

An example of one a shaped charge case 11 is shown in FIGS. 2A, 2B, and 2C. In FIG. 2A a cross section of shaped charge case 11 shows that in greater detail the difference between integral stem 12 and integral stem 80. Integral stem 12 is a rectangular shaped key as further illustrated in FIG. 2C. Integral stem 80 has a variety of keyways 82 as further illustrated in FIG. 2B. The keyways 82 in this example are arranged to provide 60 degrees of phase between each keyway. The shaped charge case 11 when fully assembled into a shaped charge may also include a cap as shown in FIG. 11. The cap ensures the explosive material and the liner is sealed off from the borehole environment. The cap may be made out of alloy steel or zinc alloy. The shaped charge case 11 also has a small amount of material 16 that seals the explosive material off from the borehole. An explosive device, such as a detonating cord, is placed in retainer 17. When the detonating cord fires it will penetrate the material 16 and detonate the explosive material inside shaped charge case 11.

Figure 3:
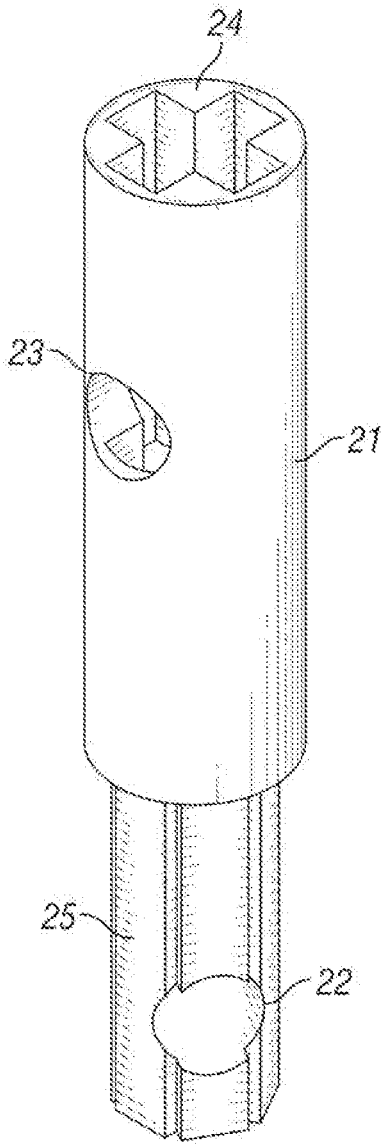
FIG. 3 is an extender.

An extension 21 as shown on FIG. 3 may be used to adjust the shot density and the phase angle. Adaptor 24 may interface with integral stem 12. Adaptor 25 may interface with the keyways 82 of integral stem 80. The extension 21 has two holes, 22 and 23, for pins 14 to secure the extension 21 to the integral stems 24 and 25. The extension 21 allows the distance between each shot to increase. Also, the phase angle in this example is adjustable using the extension 21.

Figure 4:
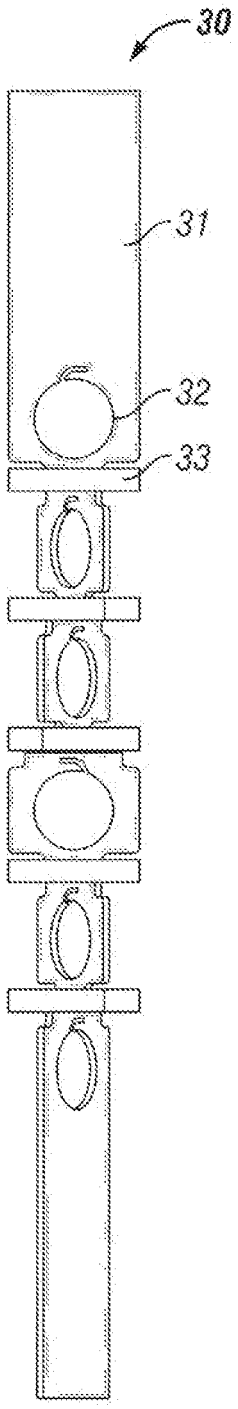
FIG. 4 is a connectable gun assembly.
Figure 5:
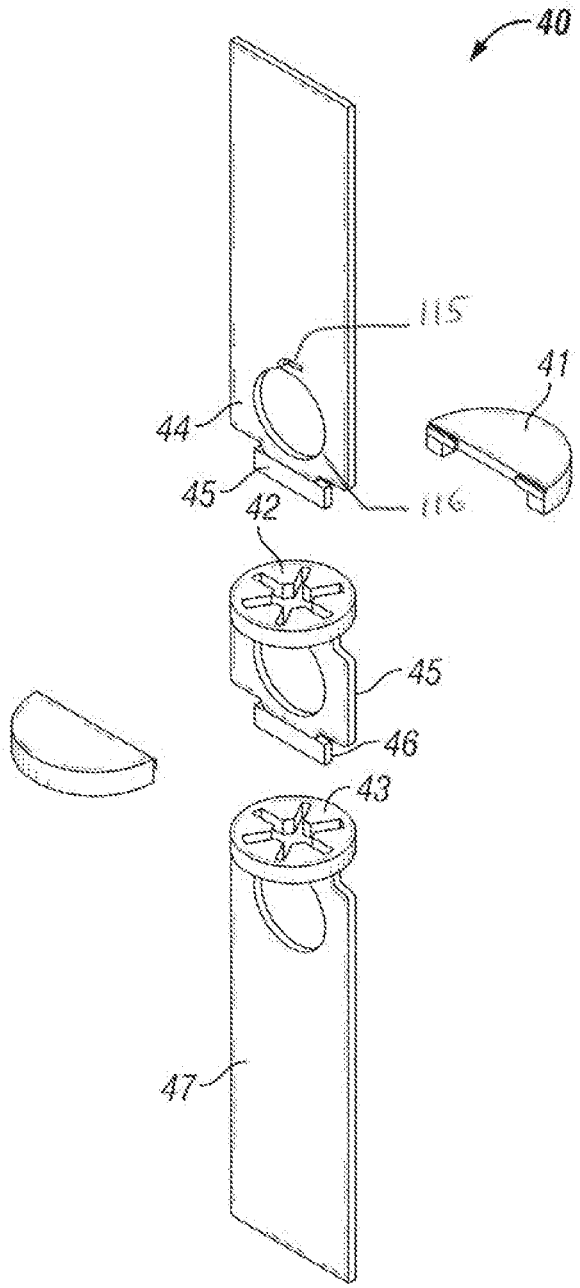
FIG. 5 is an exploded view of a connectable gun assembly.

Another example of the invention may include a rotated strip variant 30 as shown in FIG. 4. In this example a series of strip segments 44 may connect to rotatable strip segments 45 as shown in FIG. 5. In this example the rotatable strip segment 45 has an adaptor 42 configured to accept the keyway 45 of strip 44 at a variety of angles. The adaptor 42 is fixed to the keyway 45 using guide caps 41. Guide caps 41 may snap together or screw to the adaptor 42. The strip segment 43 may also have an adaptor 47. The entire rotate strip variant 30 may be composed of zinc allow in order to reduce the amount of large debris left in the borehole after firing. This design may also be used in a perforating gun with a gun body. If used in a gun body, the rotated strip variant 30 would replace the charge holder typically found in a perforating gun. If used inside of a perforating gun body the rotated strip variant 30 may be composed of plastic instead of zinc alloy. Each strip segment 44 has a through hole for fitting a shaped charge. In this example the through hole 116 has an additional locking slot 115 that allows the shaped charge to be installed at a specific orientation and then rotated until locked into place at a second installed orientation.

Figure 6A:
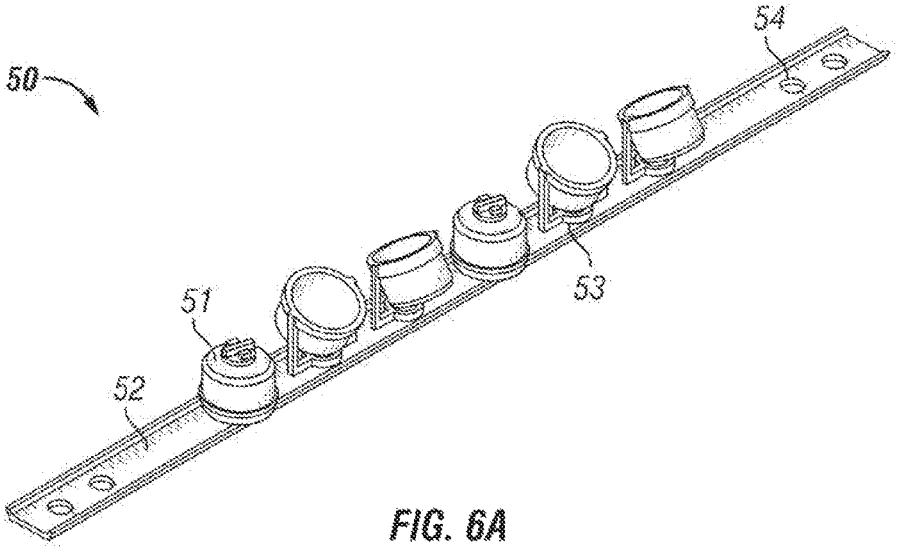
FIGS. 6A and 6C show an example of complete linked gun.

Another example of the invention may include a modified loading strip configuration 50 as shown in FIG. 6A. In this example a conventional loading strip 52 is used to hold the shaped charges 51. However, in this variant a phased bracket 53 may be used to orient the shaped charges 51 as desired. This design allows for adjustable phase angles per shot and adjustable shot density. In this configuration all of the components may be made of zinc alloy in order to reduce the likelihood of leaving large debris in the wellbore after firing the shaped charges. However, this design may also be used in a perforating gun with a gun body. If used in a gun body, the loading strip 52 would replace the charge holder typically found in a perforating gun.

Figure 6B:
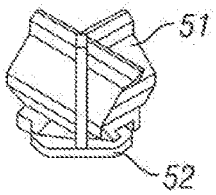
FIGS. 6B and 6D show an example retainer clip for the shaped charges.
Figure 6C:
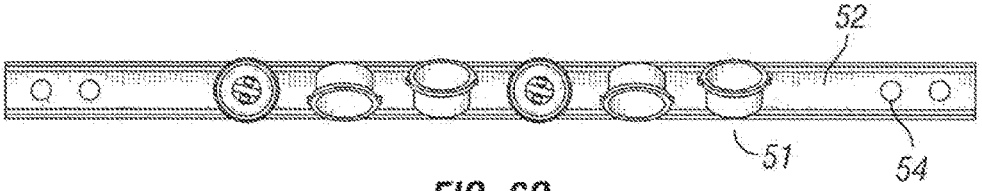
Figure 6D:
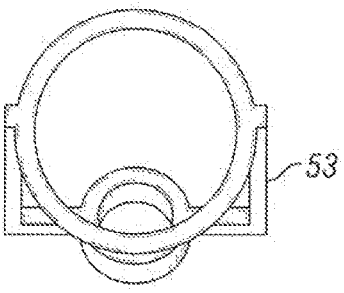

The side view of the loading strip 52 is presented in FIG. 6B. The shaped charges 51 share a common axis that they are rotated about. The top view in FIG. 6C shows the shaped charges lined up and arrayed in 60 degrees of phase between each shaped charge 51. Holes 54 allow the loading strip 52 to connect to downhole conveyance equipment including wireline, coiled tubing, or mounted within a perforating gun casing. FIG. 6D shows the phased bracket 53. The phased bracket 53 is adapted to snap or screw into the loading strip 52 as well as snap to the shaped charges 51. The phased bracket 53 may also connect to the shaped charges using a threaded screw or other fastening means. In this example the phased bracket 53 has a ring portion adapted to accept a shaped charge. It has a base portion adapted to fit into a loading strip 52. Furthermore, it has two L-shaped support members that connect the base portion to the ring portion. The L-shaped members are mirrors of each other about the center axis of the circular base portion.

Figure 7:
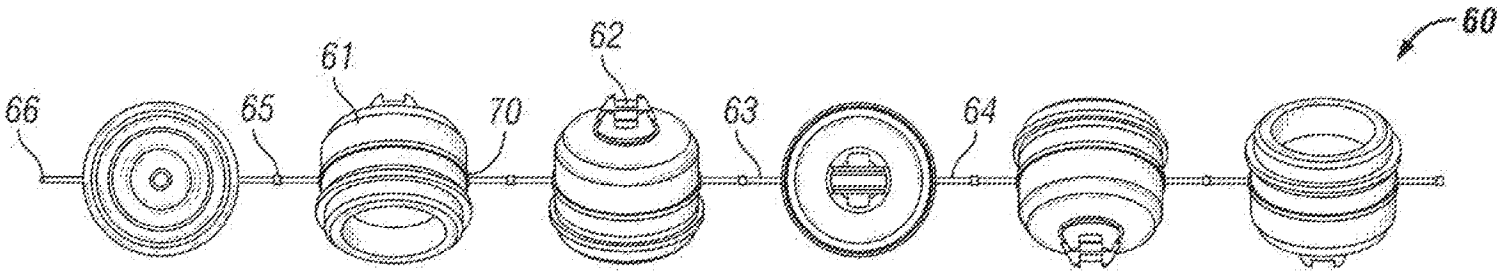
FIG. 7 shows an example of a thin connectable gun assembly.
Figure 8:
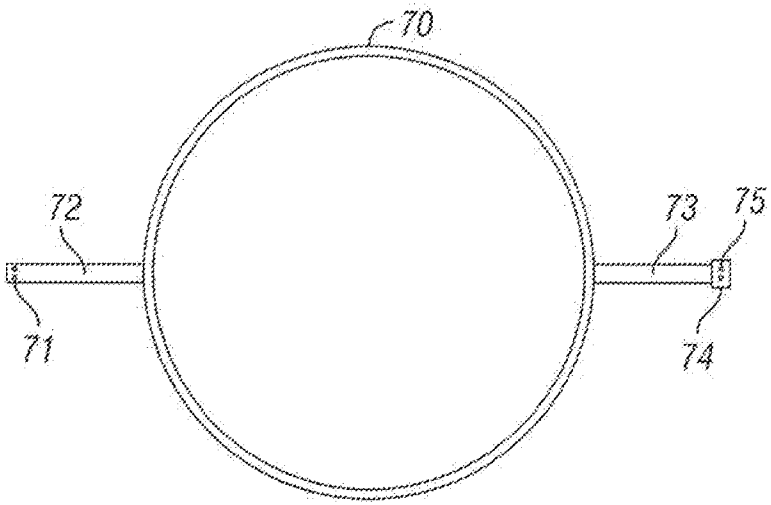
FIG. 8 shows an example of a single link for a thin connectable gun.

Another variation of the invention may include using a linked ring system 60 as shown in FIG. 7. In this configuration the shaped charges 61 snap into place in a ring 70. The ring 70 has a male stem 72 and female stem 73 as shown in FIG. 8. The male stem 72 has holes 71 arranged about the center axis every sixty degrees. The female stem 73 has holes 75 arranged about the center axis every sixty degrees. Each ring 70 can be linked to another ring 70. A series of rings 70 can be linked together and the phase angle can be adjusted as desired.

Several of the examples shown use a sixty degree phase. A phase angle of any range of angle values is appropriate, depending on the application.

Figure 9:
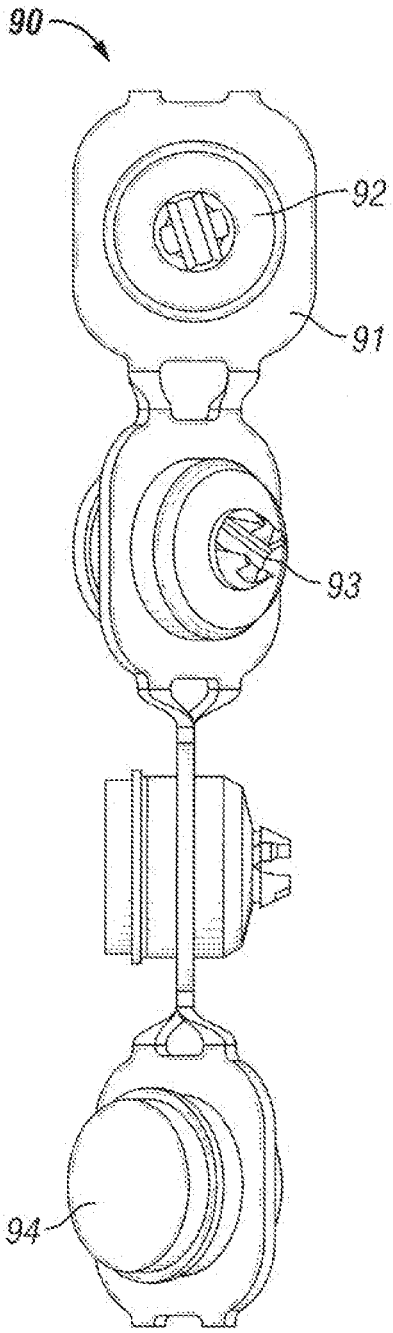
FIG. 9 shows an example of a twisted strip system.
Figure 10:
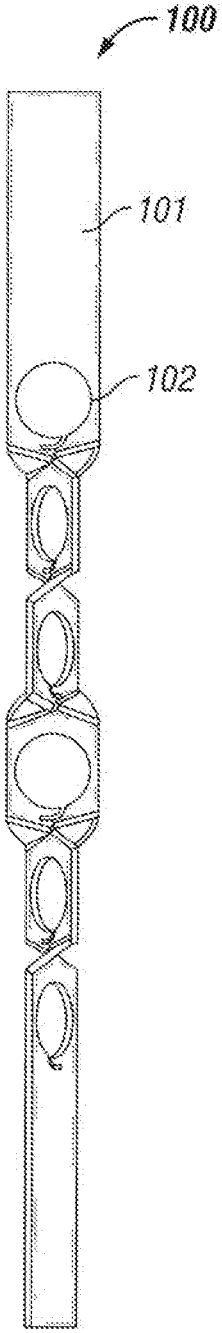
FIG. 10 shows an example of a twisted loading strip.

Another variation of the invention is a twisted loading strip 90 as shown in FIG. 9. In this case the twisted loading strip 90 has a set charge density and set phase angle. The shaped charges 92 are snapped or screwed into place in the loading strip 91. The loading strip 91 in this design may be composed of zinc alloy in order to reduce debris left in the wellbore after firing. The shaped charge 92 also has a detonating cord clip 93 and an end cap 94 to keep the outside environment from entering the interior of the shaped charge 92. A variation of the twisted loading strip 101 is shown in FIG. 10. This loading strip may be composed of zinc alloy. This design is not as adaptable as the linked system 10 shown in FIG. 1 because it has a preset shot density and phase angle.

An example of a fully loaded shaped charge 18 is shown in FIG. 11. Integral stem 12 is a rectangular shaped key. Integral stem 80 has a variety of keyways 82 as further illustrated in FIG. 2B. The keyways 82 in this example are arranged to provide 60 degrees of phase between each keyway. The shaped charge case 11 when fully assembled into a shaped charge may also include a cap 112 attached over the shaped charge case lip 113. The cap 112 ensures the explosive material 110 and the liner 111 is sealed off from the borehole environment. The cap 112 may be made out of alloy steel or zinc alloy. The shaped charge case 11 also has a small amount of material 16 that seals the explosive material off from the borehole. An explosive device, such as a detonating cord, is placed in retainer 17. When the detonating cord fires it will penetrate the material 16 and detonate the explosive material inside shaped charge case 11. A centerline is formed from the apex of liner 111 through the sealed opening of shaped charge 18. This centerline corresponds to the path an explosive jet will travel starting at the apex of liner 111 and heading out of the shaped charge 18, penetrating the cap 112 and likely any wellbore or gun casing and into the surrounding formation.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A perforating gun system comprising:

a plurality of shaped charge holder plates linked together in series, each holder plate having a male end connector and a corresponding female end connector; and a retainer to lock over a mated female and male connector.

2. A perforating gun system comprising:

a plurality of shaped charge holder plates linked together in series, each holder plate having a male end connector and a corresponding female end connector; and a retainer to lock over a mated female and male connector, wherein the retainer locks by snapping two halves of the retainer together over the mated female and male connectors.

3. A perforating gun system comprising:

a plurality of shaped charge holder plates linked together in series, each holder plate having a male end connector and a corresponding female end connector; and a retainer to lock over a mated female and male connector, wherein the retainer locks by screwing two halves of the retainer together over the mated female and male connectors.

4. A perforating gun system comprising:

a plurality of shaped charge holder plates linked together in series, each holder plate having a male end connector and a corresponding female end connector, wherein the female end connector is a cylindrical disk attached perpendicular to a shaped charge holder plate and further comprising a plurality of slots arrayed such that each slot may accept a male end connector.

* * * * *